US010294435B2

(12) United States Patent
Calderone, III et al.

(10) Patent No.: US 10,294,435 B2
(45) **Date of Patent: *May 21, 2019**

(54) MANGANESE SCAVENGERS THAT MINIMIZE OCTANE LOSS IN AVIATION GASOLINES

(71) Applicant: Afton Chemical Corporation, Richmond, VA (US)

(72) Inventors: Joseph Anthony Calderone, III, Powhatan, VA (US); Zachary John McAfee, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 211 days.

This patent is subject to a terminal disclaimer.

(21) Appl. No.: 15/340,289

(22) Filed: Nov. 1, 2016

(65) Prior Publication Data

US 2018/0119037 A1 May 3, 2018

(51) Int. Cl.

| | |
|---|---|
| ***C10L 1/10*** | (2006.01) |
| ***C10L 10/10*** | (2006.01) |
| ***C10L 1/12*** | (2006.01) |
| ***C10L 1/26*** | (2006.01) |
| ***C10L 1/30*** | (2006.01) |

(52) U.S. Cl.

CPC ..... *C10L 1/103* (2013.01); *C10L 10/10* (2013.01); *C10L 1/1241* (2013.01); *C10L 1/1283* (2013.01); *C10L 1/2608* (2013.01); *C10L 1/2641* (2013.01); *C10L 1/305* (2013.01); *C10L 2200/0227* (2013.01); *C10L 2200/0236* (2013.01); *C10L 2200/0268* (2013.01); *C10L 2200/0423* (2013.01); *C10L 2270/04* (2013.01); *C10L 2290/24* (2013.01)

(58) Field of Classification Search

CPC ..... C10L 1/103; C10L 10/10; C10L 1/1283; C10L 1/2641; C10L 1/305; C10L 2200/0227; C10L 1/2608; C10L 2200/0268; C10L 2200/0236; C10L 1/1241; C10L 2270/04; C10L 2290/24; C10L 2200/0423

See application file for complete search history.

(56) References Cited

U.S. PATENT DOCUMENTS

| | | | | |
|---|---|---|---|---|
| 2,399,805 | A | 5/1946 | Hurley et al. | |
| 2,479,902 | A | 8/1949 | Callingaert et al. | |
| 2,797,153 | A | 6/1957 | Bereslavsky | |
| 2,818,417 | A | 12/1957 | Brown et al. | |
| 2,860,958 | A | 11/1958 | Gilbert | |
| 2,889,212 | A | 6/1959 | Yust et al. | |
| 2,892,691 | A * | 6/1959 | Howell, Jr. | C10L 1/14 44/379 |
| 2,911,431 | A | 11/1959 | Orloff et al. | |
| 3,013,039 | A * | 12/1961 | Lambert | C07F 13/005 44/359 |
| 3,023,092 | A | 2/1962 | Hook et al. | |
| 3,030,009 | A | 4/1962 | Neidhardt et al. | |
| 3,030,396 | A * | 4/1962 | Gorsich | C07F 9/00 106/1.22 |
| 3,034,877 | A | 5/1962 | Popkin | |
| 3,037,038 | A | 5/1962 | Johnston et al. | |
| 3,038,791 | A | 6/1962 | Orloff | |
| 3,042,699 | A | 7/1962 | Dayton | |
| 3,052,528 | A | 9/1962 | Roddick et al. | |
| 3,054,740 | A * | 9/1962 | Schroll | C07F 13/00 204/157.75 |
| 3,055,925 | A | 9/1962 | Hartle | |
| 3,056,667 | A | 10/1962 | Payne et al. | |
| 3,060,009 | A | 10/1962 | Hook et al. | |
| 3,063,819 | A | 11/1962 | Watt et al. | |
| 3,065,742 | A | 11/1962 | Kawahara et al. | |
| 3,070,430 | A | 12/1962 | Lovett et al. | |
| 3,088,814 | A | 5/1963 | Gorsich et al. | |
| 3,092,646 | A * | 6/1963 | Wilkinson | C07F 9/70 44/359 |
| 3,113,005 | A | 12/1963 | Gilbert | |
| 3,127,351 | A | 3/1964 | Brown et al. | |
| 3,130,215 | A * | 4/1964 | Schroll | C07F 13/00 504/190 |
| 3,160,592 | A | 12/1964 | Brown | |
| 3,372,200 | A | 3/1968 | Stern, Jr. et al. | |
| 3,418,091 | A | 12/1968 | Barusch et al. | |
| 3,442,361 | A | 5/1969 | Gluckstein | |
| 3,522,023 | A | 7/1970 | Norton | |

(Continued)

FOREIGN PATENT DOCUMENTS

| | | |
|---|---|---|
| CN | 102746919 A | 10/2012 |
| FR | 1162768 | 9/1958 |

(Continued)

OTHER PUBLICATIONS

ASTM D910-17A (Available online Nov. 2018).*

European Search Report, European Application No. 17161575.0, dated Jul. 10, 2017, 8 pages.

Examination Report No. 1 for corresponding AU Application No. AU 2017201887 dated Sep. 11, 2017.

Examination Report No. 1 for corresponding AU Application No. AU 2017201950 dated Sep. 11, 2017.

(Continued)

*Primary Examiner* — Pamela H Weiss

(74) *Attorney, Agent, or Firm* — Honigman LLP

(57) ABSTRACT

Aviation gasolines and additives may have manganese-containing anti-knock components. The scavengers herein mitigate the possible deleterious effects from using the manganese-containing anti-knock. The scavengers include molecules with a central atom of a Group 15 element other than nitrogen. Entities that are attached to the central atom are electron withdrawing entities including electron deficient atoms and electron deficient functional groups.

12 Claims, No Drawings

(56) References Cited

U.S. PATENT DOCUMENTS

| | | | | |
|---|---|---|---|---|
| 3,558,292 | A | 1/1971 | Abowd | |
| 3,560,174 | A | 2/1971 | Newman et al. | |
| 3,615,293 | A | 10/1971 | Hnidza | |
| 3,658,497 | A | 4/1972 | Sung et al. | |
| 3,966,429 | A | 6/1976 | Sprague et al. | |
| 4,005,993 | A | 2/1977 | Niebylski et al. | |
| 4,390,345 | A | 6/1983 | Somorjai | |
| 4,720,288 | A | 1/1988 | Croudace et al. | |
| 5,470,358 | A | 11/1995 | Gaughan | |
| 5,511,517 | A | 4/1996 | Perry et al. | |
| 5,851,241 | A | 12/1998 | Studzinski et al. | |
| 5,944,858 | A | 8/1999 | Wallace | |
| 6,187,064 | B1 | 2/2001 | Henderson | |
| 6,238,446 | B1 | 5/2001 | Henderson | |
| 6,258,134 | B1 | 7/2001 | Studzinski et al. | |
| 6,451,075 | B1 | 9/2002 | Schoppe et al. | |
| 6,652,608 | B1 * | 11/2003 | Orr | C10L 1/023 44/314 |
| 7,572,303 | B2 | 8/2009 | Orr | |
| 7,740,668 | B2 | 6/2010 | Gaughan et al. | |
| 7,775,166 | B2 | 8/2010 | Aradi et al. | |
| 7,833,295 | B2 | 11/2010 | Clark | |
| 7,897,034 | B2 | 3/2011 | De Oliveira et al. | |
| 8,016,897 | B2 | 9/2011 | Lowery | |
| 8,232,437 | B2 | 7/2012 | Clark et al. | |
| 8,628,594 | B1 | 1/2014 | Braly | |
| 8,734,540 | B2 | 5/2014 | Aradi et al. | |
| 9,035,114 | B1 | 5/2015 | Shea et al. | |
| 9,127,225 | B2 | 9/2015 | Shea et al. | |
| 9,856,431 | B2 * | 1/2018 | Factor | C10L 10/10 |
| 2002/0005008 | A1 | 1/2002 | Studzinski et al. | |
| 2002/0045785 | A1 | 4/2002 | Bazzani et al. | |
| 2003/0040650 | A1 | 2/2003 | Butler et al. | |
| 2004/0124122 | A1 | 7/2004 | Clark | |
| 2005/0044778 | A1 | 3/2005 | Orr | |
| 2005/0188606 | A1 | 9/2005 | Caprotti | |
| 2006/0123696 | A1 | 6/2006 | Gaughan et al. | |
| 2006/0219096 | A1 | 10/2006 | Aradi et al. | |
| 2008/0000148 | A1 | 1/2008 | Cunningham | |
| 2008/0005958 | A1 | 1/2008 | Factor | |
| 2008/0134571 | A1 | 6/2008 | Landschof | |
| 2008/0244963 | A1 | 10/2008 | Demoment et al. | |
| 2010/0107480 | A1 | 5/2010 | Lowery | |
| 2010/0263262 | A1 | 10/2010 | Gaughan | |
| 2011/0114536 | A1 | 5/2011 | Demoment | |
| 2012/0000115 | A1 | 1/2012 | Shastri | |
| 2012/0026291 | A1 | 2/2012 | Hemighaus et al. | |
| 2013/0111805 | A1 | 5/2013 | Mathur et al. | |
| 2014/0116367 | A1 | 5/2014 | Braly | |
| 2014/0123548 | A1 | 5/2014 | Braly | |
| 2014/0128644 | A1 | 5/2014 | Braly | |
| 2015/0113861 | A1 | 4/2015 | Shea et al. | |
| 2015/0113862 | A1 | 4/2015 | Shea et al. | |
| 2015/0113866 | A1 | 4/2015 | Shea et al. | |
| 2015/0175920 | A1 | 6/2015 | Shea et al. | |
| 2015/0175921 | A1 | 6/2015 | Shea et al. | |
| 2015/0259619 | A1 | 9/2015 | Albuzat et al. | |
| 2017/0283728 | A1 * | 10/2017 | McAfee | C10L 1/14 |

FOREIGN PATENT DOCUMENTS

| | | | | |
|---|---|---|---|---|
| GB | 708006 | A | 4/1954 | |
| GB | 733820 | A * | 7/1955 | C10L 1/14 |
| GB | 898343 | A | 6/1962 | |
| GB | 872820 | | 7/1962 | |
| GB | 900446 | A | 7/1962 | |
| GB | 936364 | A | 9/1963 | |
| GB | 946062 | A * | 1/1964 | B01J 31/185 |
| GB | 969913 | A | 9/1964 | |
| GB | 1343907 | | 1/1974 | |
| GB | 2248068 | | 3/1992 | |
| RU | 2314334 | | 1/2008 | |
| WO | 9640844 | | 12/1996 | |
| WO | 0222766 | A1 | 3/2002 | |
| WO | 2005087901 | | 9/2005 | |
| WO | 2015197855 | | 12/2015 | |
| WO | 2016010966 | | 1/2016 | |
| WO | 2017123314 | A1 | 7/2017 | |

OTHER PUBLICATIONS

International Application Serial No. PCT/US/16/60749; Notification of Transmittial of The International Search Report and The Written Opinion of the International Searching Authority; 16 pages, dated Jan. 13, 2017.

Partial European Search Report, European Application No. EP 17161582.6, dated Jun. 9, 2017, 15 pages.

Thomas A. Ward, 3.4.1 Aviation Fuel, Aerospace Propulsion Systems, Jan. 1, 2010, pp. 202-213, 13 pages.

Gunderloy F.C.,Neblett R.F.; Effect of Phosphorous Deposit Modifiers on Gasoline Octane Quality. Journal of Chemical and Engineering Data. 1962, vol. 7 No. 1; pp. 142-145; 4 pages.

Livingston H.K.; Antiknock Antogonists. Industrial and Engineering Chemistry. 1951, vol. 43 No. 3; pp. 663-671; 9 pages.

European Search Report, European Application No. 17198723.3, dated Feb. 20, 2018, 5 pages.

Jinsong Liu, et al., Aviation Materials and Heat Treatment, National Defence Industry Press, Jul. 31, 2008, pp. 257-259.

English Translation of Chinese Search Report, CN Application No. 201710191892.1, dated Jul. 19, 2018.

* cited by examiner

MANGANESE SCAVENGERS THAT MINIMIZE OCTANE LOSS IN AVIATION GASOLINES

The present invention is directed to manganese scavengers in aviation gasolines. Specifically, the manganese scavengers help to prevent or reduce spark plug fouling and manganese deposits in internal combustion engines that run on aviation gasoline. These manganese scavengers, consisting of certain organometallic compounds, surprisingly do not significantly reduce the octane rating of the aviation gasoline.

BACKGROUND

Scavengers are historically employed with fuels that are combusted in internal combustion engines; in particular with fuels that already contain organometallic additives. The intent of adding scavengers is to mitigate or preferably eliminate any deleterious effects of the organometallic already used in the fuel including fouling and deposits formed in the engine.

Acknowledging the potent effects of organolead compounds as octane enhancers and antiknock additives, the piston engine aviation industry incorporated these compounds into aviation gasoline. Although organolead compounds provide significant benefits to aircraft piston engines in terms of octane rating enhancement, the lead deposits that form upon combustion are known to have deleterious effects on engine operability. In particular, the aviation industry is well aware of the propensity of lead deposits to foul piston engine spark plugs and cause misfiring. To ameliorate some of the negative aspects of combustion of organolead additives in internal combustion engines, lead scavengers have been incorporated into aviation gasoline. However, the aviation industry now seeks the removal of lead from aviation gasoline. The development of unleaded aviation gasoline that meets the industry standards for engine performance and operability remains a technologically challenging problem.

Replacing organolead antiknock additives with organornanganese compounds is a viable and promising solution. In one example, an organometallic manganese compound, specifically methylcyclopentadienyl manganese tricarbonyl (MMT), is employed as an octane booster. With these fuels that contain MMT, it is then desirable to employ a manganese scavenger to reduce or prevent fouling and deposit formation caused during the combustion of that fuel. Organobromine and organochlorine compounds, which are the most common lead scavengers, are believed relatively ineffective with manganese containing fuels. Instead, it is generally believed that phosphorous compounds are the most effective and commercially viable manganese scavengers. Unfortunately, it is known in the industry that phosphorous-containing scavengers can reduce the Motor Octane Number (MON) of a fuel containing organometallic antiknock compounds, including for instance the manganese-containing antiknock compounds. The mechanism of action is believed to be an antagonistic effect between the organometallic antiknock compounds and the scavenger that reduces the MON enhancing effect of the organometallic compound. This antagonistic effect on octane rating is significant enough to eliminate the practicality of an aviation gasoline containing manganese antiknock compounds.

Based on the prior art, tricresyl phosphate (TCP) is a well-known phosphorous based lead and manganese scavenger. However, TCP can reduce octane (MON) to unacceptable levels, as shown for instance in Example 1 below. Because of the challenge of meeting the high octane requirement, currently, of at least 99.6 Motor Octane Number (based on ASTM D-910) for aviation gasoline, even a small improvement in the antiknock effectiveness is significant. Thus the decrease in Motor Octane Number observed when employing TCP is significant enough to limit the commercialization of unleaded aviation gasoline containing organomanganese antiknocks that include TCP. Example 1 further shows some other phosphates that have similar or in fact worse impact on the MON.

The discovery detailed below describes the application of preferably phosphites and more preferably phosphines as manganese scavengers that limit the MON loss in aviation gasoline containing manganese antiknock compounds.

SUMMARY

Accordingly, it is an object of the present invention to provide a manganese scavenger that minimizes octane loss when used in aviation gasolines.

In one instance, an aviation gasoline formulation comprises an aviation gasoline base fuel and a manganese-containing anti-knock component. The formulation also includes a manganese scavenger component that comprises molecules made up of a central atom and entities attached to the central atom. The central atom is a Group 15 element selected from the group consisting of phosphorus, arsenic, antimony, and bismuth. The entities attached to the central atom are electron withdrawing entities selected from the group consisting of electron deficient atoms and electron deficient functional groups.

In another instance, there is disclosed a method of improving the performance of organomanganese aviation gasoline additive compounds during the combustion of that gasoline in an aviation internal combustion engine. The method includes the steps of providing an aviation gasoline formulation that includes an organomanganese anti-knock compound and mixing into that formulation a manganese scavenging component comprising molecules made up of a central atom and entities attached to the central atom. The central atom is a Group 15 element selected from the group consisting of phosphorus, arsenic, antimony, and bismuth. The entities attached to the central atom are electron withdrawing entities selected from the group consisting of electron deficient atoms and electron deficient functional groups.

DETAILED DESCRIPTION

Common manganese scavengers include a phosphorous component. As explained earlier, existing phosphorous-based scavengers, notably TCP, does significantly reduce the Motor Octane Number or antiknock effects of an organomanganese fuel additive. Antiknock effectiveness is referred to herein as the measure of antagonistic effects of traditional phosphorous scavengers on organomanganese antiknock compounds. However, the scavenging benefits of phosphorous-containing components are desirable. Other Group 15 elements including arsenic, antimony, and bismuth may be similarly effective scavengers, but they will have similar antagonistic effects with respect to the desirable MON and antiknock effectiveness of organomanganese additives. The scavengers discussed herein are exemplified in mostly phosphorous examples, but any of the Group 15 central atoms (except nitrogen) in addition to phosphorous may be alternatively used as an effective scavenger.

Manganese scavengers described herein include a central atom and typically three entities attached to the central atom. The central atom is a Group 15 element, not including nitrogen. The relevant Group 15 elements, therefore, include phosphorous, arsenic, antimony and bismuth. The subsequent reference herein to Group 15 elements means the foregoing elements, and not nitrogen. The figures below depict abovementioned compounds:

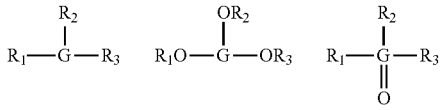

The Group 15 element, excluding nitrogen, is defined as the central atom, G. The substituent groups attached to the central atom (G) are described as possessing a G-R bond where atom R, bonding to G, is a carbon as in the case of $R_1$, $R_2$, and $R_3$. Additionally in the case of compounds containing a G-R bond, the central atom can be in the +5 oxidation state. An example of this would be a phosphine oxide. Alternatively the central atom (G) can possess a G-OR bond, where the atom bonding to element G is an oxygen atom as in the case of $OR_1$, $OR_2$, and $OR_3$. Groups $R_1$, $R_2$, and $R_3$ as well as $OR_1$, $OR_2$, and $OR_3$ can be identical or unique. Furthermore, the central atom (G) can possess a mixture of both R and OR groups. It is preferential both the R and OR groups contain electron withdrawing entities including aryl and substituted aryl groups, atoms with electron withdrawing effects, heteroaryl and substituted heteroaryl groups, linear or branched carbon chains further possessing groups or atoms capable of electron withdrawing effects. In conjunction with electron withdrawing effects, steric effects play a role —R and OR groups consisting of branched alkyl groups are preferred to linear carbon chains. The degree of electron withdrawing effects as well as steric effects will be defined below.

The entities attached to the Group 15 central atom have an electron withdrawing effect on the central atom. One or more of the entities are either electron deficient atoms or are electron deficient functional groups. One or more of the entities attached to the central atom have this electron withdrawal effect. Alternatively, two or more or all of the attached entities have an electron withdrawal effect.

The Tolman electronic parameter is known to those skilled in the art to be influenced by a compounds ability to donate or withdraw electrons. The Tolman electronic parameter is established by measuring the frequency of the C—O bond vibration in a model organometallic compound, typically a nickel carbonyl complex -$LNi(CO)_3$, where L is the compound whose Tolman electronic parameter is being measured. The C—O bond vibrational frequency of the $LNi(CO)_3$ changes as a function of how the compound, L, increases or decreases electron density at the metal center. This change in electron density at Ni is dependent on the electron withdrawing or electron donating ability of the compound under study (L). Since the invention unexpectedly identified electron deficient organophosphorous compounds as being optimal for reducing octane number loss in manganese containing aviation gasoline, the Tolman electronic parameter generally presents a useful metric quantifying the degree of electron withdrawing effects required to minimize octane number loss.

Electronic effects, notably electron withdrawing effects, are believed to tell only a part of the story with respect to octane number loss in manganese containing aviation gasoline. Steric effects based on the size of the substituent groups are believed to play a role as well. For example, it has been discovered that when R=cycloalkyl less octane number loss was measured compared to when R=n-octyl. To aid in quantifying desirable steric effects, it is believed that the Tolman cone angle is useful. Those skilled in the art understand the Tolman cone angle is a measure of the size of a compound. It can be defined as the angle formed when a cone is drawn with the metal center as the apex and the outermost atoms as the perimeter of the base of the cone. For example bulkier more sterically congested compounds, exhibit larger Tolman cone angles.

Since both steric effects as well as electronic effects are believed to influence octane number loss it is useful to define desirable compounds in terms of both the Tolman electronic parameter and Tolman cone angle. Most desirable organophosphorous compounds could be classified into several ranges.

One group of favorable manganese scavengers includes phosphites containing OR groups such as aryloxy, alkoxy and their substituted counterparts. Examples of these phosphorous-containing molecules include triphenyl phosphite, tris(4-fluorophenyl)phosphite, and tris(4-(trifluoromethyl) phenyl)phosphite. One exception is tris(4-chlorophenyl) phosphite, since those skilled in the art understand in this case chlorine can exert an electron donating effect through resonance. Amongst alkoxides examples of these phosphorous-containing molecules include tris(2,2,2-trifluoromethyl)phosphite and tris(2,2,2-trichloromethyl)phosphite. In this instance the chlorine atom solely exerts an electron withdrawing effect. Phosphites, including also those not mentioned above, with a Tolman electronic parameter ranging from 2085-2110 $^{v}CO(A_1)$ and Tolman cone angle ranging from 110-135 θ, with the exception of those containing groups capable of electron donating effects, are reasonably expected to minimize octane loss in manganese containing aviation gasoline.

Phosphites containing aryloxy groups in which the Tolman electronic parameter and/or Tolman cone angle have not been measured but nonetheless contain electron withdrawing groups fall under the scope herein. For example, replacement of a phenyl ring with a polyaromatic or heteroaryl ring (where the heteroatom is nitrogen, oxygen, or sulfur) will still exert a desirable electron withdrawing effect. Likewise other electron withdrawing substituents on the aryl group are expected to be desirable with respect to minimizing octane number loss. Said substituent groups include electron withdrawing substituents including, but not limited to, halogens (except chlorine), pseudohalogens, ketones, aldehydes, nitro groups, esters, or other functional groups that exert electron withdrawing effects.

Likewise, phosphites containing electron deficient alkoxy groups but without a measured Tolman electronic parameter and/or the Tolman cone angle fall under the scope herein. For example, these groups may include electron withdrawing atoms such as halogens (including chlorine), oxygen, sulfur, or other similar atoms that exert a similar electron withdrawing effect. The alkoxy group may include aromatic, polyaromatic, or heteroaromatic groups that function to withdraw electrons. Other examples include alkoxy groups containing double bonds, triple bonds or conjugated systems which withdraw electrons. Further examples of functional groups that withdraw electrons include but are not limited to ketones, esters, aldehydes, amides or similar functional groups.

Another group of favorable manganese scavengers includes phosphines containing R groups such as aryl, alkyl and their substituted counterparts. An example of an aryl group attached to a Group 15 atom includes triphenyl phosphine. Other examples include tris(4-fluorophenyl) phosphine and tris(perfluorophenyl)phosphine. One exception is tris(4-chlorophenyl)phosphine, since those skilled in the art understand in this case chlorine can exert an electron donating effect through resonance. The above mentioned phosphines fall within Tolman electronic parameters ranging from of 2067-2080 $^{v}CO(A_1)$ and Tolman cone angles ranging from 140-160 θ; or alternatively Tolman electronic parameter ranging from 2080-2095 $^{v}CO(A_1)$ and Tolman cone angle ranging from 160-185 θ. Other organophosphorous compounds that fall within these ranges and do not exert an electron donating effect would be reasonably expected to perform well. An example of an alkyl substituted phosphine capable of reducing octane number loss is tricyclohexyl phosphine. A compound with a Tolman electronic parameter ranging from 2050-2060 $^{v}CO(A_1)$ and Tolman cone angle ranging from 165-175 θ is reasonably expected to perform similarly to tricyclohexyl phosphine. Compounds with both cyclohexyl and aryl substituents, such as cyclohexyldiphenyl phosphine and dicyclohexylphenyl phosphine, have shown to be effective at minimizing octane number loss as well.

Phosphines containing aryl groups in which the Tolman electronic parameter and/or the Tolman cone angle have not been measured but still contain electron withdrawing groups fall under the scope herein. For example, replacement of a phenyl ring with a polyaromatic or heteroaryl ring (where the heteroatom is nitrogen, oxygen, or sulfur) will still exert a desirable electron withdrawing effect. Likewise other electron withdrawing substituents on the aryl group are expected to be desirable with respect to minimizing octane number loss. Said substituent groups include electron withdrawing substituents including, but not limited to, halogens (except chlorine), pseudohalogens, ketones, aldehydes, nitro groups, esters, or other functional groups that exert electron withdrawing effects.

Likewise, phosphines containing electron deficient alkyl groups but without a measured Tolman electronic parameter and/or Tolman cone angle fall under the scope herein. For example, these groups may include electron withdrawing atoms such as halogens (including chlorine), oxygen, sulfur, or other similar atoms that exert a similar electron withdrawing effect. The alkyl group may include aromatic, polyaromatic, or heteroaromatic groups that function to withdraw electrons. Other examples include alkyl groups containing double bonds, triple bonds or conjugated systems which withdraw electrons. Further examples of functional groups that withdraw electrons include but are not limited to ketones, esters, aldehydes, amides or similar functional groups.

Phosphine oxides were found effective at minimizing octane number loss in manganese containing aviation gasoline. A prime example of this is triphenyl phosphine oxide. Phosphine oxides containing other aromatic substituents, such as polyaromatic rings or heteroaryl rings (where the heteroatom is nitrogen, oxygen, or sulfur) are desirable as well. Likewise other electron withdrawing substituents on the aryl group are expected to be desirable with respect to minimizing octane number loss. Said substituent groups include electron withdrawing substituents including, but not limited to, halogens (except chlorine), pseudohalogens, ketones, aldehydes, nitro groups, esters, or other functional groups that exert electron withdrawing effects.

Likewise, phosphine oxides containing electron deficient alkyl groups fall under the scope herein. For example, these groups may include electron withdrawing atoms such as halogens (including chlorine), oxygen, sulfur, or other similar atoms that exert a similar electron withdrawing effect. The alkyl group may include aromatic, polyaromatic, or heteroaromatic groups that function to withdraw electrons. Other examples include alkyl groups containing double bonds, triple bonds or conjugated systems which withdraw electrons. Further examples of functional groups that withdraw electrons include but are not limited to ketones, esters, aldehydes, amides or similar functional groups. An example of an alkyl substituted phosphine capable of reducing octane number loss is tricyclohexyl phosphine oxide. Compounds with both cyclohexyl and aryl substituents, such as cyclohexyldiphenyl phosphine oxide and dicyclohexylphenyl phosphine oxide are reasonably expected to minimize octane number loss.

Conversion of the phosphines with Tolman electronic parameters ranging from of 2067-2080 $^{v}CO(A_1)$ and Tolman cone angles ranging from 140-160 θ or alternatively Tolman electronic parameter ranging from 2080-2095 $^{v}CO(A_1)$ and Tolman cone angle ranging from 160-185 θ to the corresponding phosphine oxides is within the scope herein. It is well known that phosphines will oxidize to their corresponding phosphine oxide upon exposure to air. The conversion of triphenyl phosphine to its oxide bad a favorable effect on octane number.

Of course the Tolman electronic parameter and Tolman cone angle are not established for all possible organophosphorous compounds. In such an instance where the values have not been established, it is useful to compare a "new compound" to an organophosphorous compound with an established Tolman electronic parameter and Tolman cone angle. Those skilled in the art will understand that if the new compound is structurally or functionally similar, in that the atoms or functional groups which exert the electron withdrawing effect are bonded in chemically similar manner, or additionally create an electron withdrawing effect similar to a compound with established Tolman values, the new compound can be considered substantially similar in terms of both structure and functionality. One would reasonably expect the new compound to function, that is minimize the MON loss in aviation gasoline containing organomanganese antiknocks, in a manner similar to the compound with established Tolman values. One non-limiting example is replacing the chlorine atoms of $P(OCH_2CCl_3)_3$ with fluorine atoms to create $P(OCH_2CF_3)_3$. It is believed that no Tolman values exist for $P(OCH_2CF_3)_3$. However, because fluorine exerts a powerful electron withdrawing effect, in fact more powerful than chlorine, one would reasonably expect $P(OCH_2CF_3)_3$ to function well at minimizing the MON loss in aviation gasoline containing organomanganese antiknocks. A further non-limiting example replaces the substituent groups of $P(OCH_2CF_3)_3$ to $P(OCH_2CH_2CF_3)_3$. In this case, although an additional methylene group will not alter the functionality of $P(OCH_2CH_2CF_3)_3$ due to the fact the fluorine atoms can still exert an electron withdrawing effect via induction in a manner similar to $P(OCH_2CCl_3)_3$.

The Table A below details some example optimal ranges for the Tolman electronic parameter and Tolman cone angle that corresponded to some of the above and following exemplary scavenger compounds that resulted in reduced octane number loss in aviation gasoline:

TABLE A

| Organophosphorous Compound | Tolman Electronic Parameter ν̃CO | Tolman Cone Angle θ | Example Compounds |
|---|---|---|---|
| Phosphites | 2085-2110 | 110-135 | Triphenyl phosphite |
| Phosphines | 2050-2060 | 165-175 | Tricyclohexyl phosphine |
| | 2067-2080 | 140-160 | Triphenyl phosphine |
| | 2080-2095 | 160-185 | Tris(perfluorophenyl) phosphine |

The manganese scavenger described herein is added to a fuel at a treat rate that corresponds to the amount of manganese being added to the fuel and the scavenging effectiveness of the scavenger. For example, the scavenger compound may be added at a rate of about 0.01 to 300 mg of the Group 15 element in the compound per liter of the finished fuel, or alternatively about 5 to 50 mg per liter. In the example of a scavenger compound that has a central atom of phosphorous, the treat rate may be about 0.01 to 300 mg of phosphorous per liter of finished fuel, or alternatively about 5 to 50 mg of phosphorous per liter. The base fuel is free or substantially free of any lead-containing additive.

An additive package may consist of a scavenger compound, for instance triphenyl phosphine, dissolved in an aromatic solvent such as A150 to create a solution that ranges from 1% to 50% triphenyl phosphine by mass, more preferably 10-30% triphenyl phosphine by mass. These same mass ranges may apply as well to other scavenger compounds as discussed herein. This solution can contain an organomanganese based antiknock. Preferably this organomanganese antiknock is methylcyclopentadienyl manganese tricarbonyl (MMT). The concentration of MMT can range from 1% to 90% by weight but the preferred concentration of MMT ranges from 50% to 70% by weight.

Examples of successful, and some unsuccessful, scavenger compounds are set forth in the following examples.

EXAMPLE 1

An aviation gasoline consisting of 80 volume percent alkylate, 15 volume percent toluene and 5 volume % isopentane was treated with 125 mg Mn/L, from MMT. To this base fuel a panel of manganese scavengers, consisting of the organophosphorous compounds shown in Table 1, was added. Sufficient scavenger was used to deliver 89 mg P/L of to the fuel. Antagonistic effects of the phosphorous scavenger with MMT varied significantly by structure. The antagonistic effects are measured by the reduction in MON caused when the scavenger is added as a percentage of the MON benefit from using the manganese antiknock without a scavenger. Tricresyl phosphate, a lead and manganese scavenger well known to the aviation industry, reduced the antiknock effectiveness of MMT to 47.8%. A similar organophosphorous Mn scavenger, triphenyl phosphate, reduced MMT's antiknock effectiveness to a similar level. Triisopropyl phosphate and dimethyl methyl phosphonate (DMMP) replaces the P—OAr moiety with P—OAlkyl, and/or P-Alkyl groups. Removal of the OAr group, proved deleterious to antiknock effectiveness. In this instance at a high phosphorous treat rate organophosphorous Mn scavengers such as triphenyl phosphite afforded antiknock effectiveness similar to aryloxy substituted pentavalent organophosphorous manganese scavengers. Unexpectedly, replacement of aryloxy substituents with aryl substituents as in the case of triphenyl phosphine resulted in a dramatic increase in antiknock effectiveness. A similar trend is observed when incorporating triphenyl phosphine oxide.

TABLE 1

| Blend | Motor Octane Number | % Antiknock Effectiveness |
|---|---|---|
| Base Fuel Control (No MMT) | 94.7 | 0.0% |
| No Scavenger Control | 97.0 | 100% |
| Tricresyl Phosphate | 95.8 | 47.8% |
| Triphenyl Phosphate | 95.9 | 52.2% |
| Triisopropyl Phosphate | 94.4 | <0.0% |
| Dimethyl Methyl Phosphonate | 94.1 | <0.0% |
| Triphenyl Phosphite | 95.5 | 34.8% |
| Triphenyl Phosphine | 96.4 | 73.9% |
| Triphenyl Phosphine Oxide | 96.8 | 91.3% |

EXAMPLE 2

An aviation gasoline consisting of 80 volume percent alkylate, 15 volume percent toluene and 5 volume % isopentane was treated with 125 mg Mn/L, from MMT. To this base fuel a manganese scavenger, consisting of the organophosphorous compounds shown in Table 2, was added. Sufficient scavenger was used to deliver either 33 and/or 67 mg P/L of to the fuel. Alkoxy or P-Alkyl substituents proved especially harmful to the antiknock effectiveness of MMT despite being used at lower treat rates. This clearly demonstrates electron rich substituents, such as the above mentioned alkoxy or alkyl groups, have a negative impact on the antiknock effectiveness of MMT. Electron poor substituents are more preferred. An aryloxy group, which is electron poor due to the resonance effect of the aromatic ring, is one such example of an electron poor substituent. Other electron poor (or electron withdrawing group) substituents are aryl groups that bond directly to phosphorous. Such examples are triphenyl phosphine and triphenyl phosphine oxide shown in Table 2.

TABLE 2

| Blend | Treat Rate of Scavenger (mg P/L) | Motor Octane Number | % Antiknock Effectiveness |
|---|---|---|---|
| Base Fuel Control (No MMT) | 0 | 94.7 | 0.0% |
| No Scavenger Control | 0 | 97.0 | 100% |
| Triphenyl Phosphate | 33 | 96.0 | 56.5% |
| Triisopropyl Phosphate | 33 | 95.3 | 26.1% |
| Triphenyl Phosphite | 33 | 95.9 | 52.2% |
| Dimethyl Methyl Phosphonate | 33 | 94.2 | <0.0% |
| Triphenyl Phosphate | 67 | 96.0 | 56.5% |
| Triisopropyl Phosphate | 67 | 94.6 | <0.0% |
| Dimethyl Methyl Phosphonate | 67 | 94.3 | <0.0% |
| Triphenyl Phosphite | 67 | 95.7 | 43.5% |
| Triphenyl Phosphine | 67 | 97.0 | 100% |
| Triphenyl Phosphine Oxide | 67 | 96.7 | 87.0% |

EXAMPLE 3

An aviation gasoline consisting of 80 volume percent alkylate, 15 volume percent toluene and 5 volume % isopentane was treated with 125 mg Mn/L, from MMT. In this particular example the Motor Octane Number of this fuel was measured to be 96.7. To this fuel a manganese scavenger, triphenyl phosphine was added at a treat rate of 125 mg P/L. Despite this very high treat rate of Mn scavenger, the Motor Octane Number was measure to be 95.6. Indicating MMT retained an antiknock effectiveness of 45.0%. This demonstrates triphenyl phosphine, with its electron deficient substituents, can be incorporated into aviation gasoline blends at high treat rates without completely inactivating the antiknock effectiveness of MMT.

EXAMPLE 4

An aviation gasoline consisting of 80 volume percent alkylate, 15 volume percent toluene and 5 volume % isopentane was treated with 125 mg Mn/L, from MMT. To this base fuel a manganese scavenger consisting of another Group 15 element, antimony, was added. Triphenyl antimony is a structural analogue of triphenyl phosphine. When the phosphorous atom is replaced with chemically similar antimony, antiknock effectiveness is similar to aviation gasoline treated with triphenyl phosphine. It is expected that other Mn scavengers containing other Group 15 elements would behave in a similar manner as organophosphorous Mn scavengers. More preferred examples are Mn scavengers containing Group 15 elements that are bonded to electron deficient substituents including but not limited to aryl groups.

TABLE 3

| Blend | Treat Rate of Scavenger (mg P/L) | Motor Octane Number | % Antiknock Effectiveness |
|---|---|---|---|
| Base Fuel Control (No MMT) | 0 | 94.7 | 0.0% |
| No Scavenger Control | 0 | 98.2 | 100% |
| Triphenyl Antimony | 16.44 | 97.5 | 80.0% |
| Triphenyl Antimony | 50 | 96.8 | 60.0% |
| Triphenyl Antimony | 89 | 97.1 | 68.6% |

EXAMPLE 5

An aviation gasoline consisting of 80 volume percent alkylate, 15 volume percent toluene and 5 volume % isopentane was treated with 125 mg Mn/L, from MMT. This fuel was then treated with substituted triphenyl phosphines with both electron withdrawing and electron donating functional groups. As shown in Table 4, substituted triphenyl phosphines with neutral or electron withdrawing groups proved to be less antagonistic towards MMT—greater antiknock effectiveness values were observed. Installing an electron withdrawing fluorine in the para position proved to be particularly beneficial.

TABLE 4

| Blend | Aryl Substituent Effect | Motor Octane Number | % Antiknock Effectiveness |
|---|---|---|---|
| Base Fuel Control (No MMT) | N/a | 94.7 | 0.0% |
| No Scavenger Control | N/a | 97.7 | 100% |
| Tris(p-methoxyphenyl)phosphine | EDG | 96.6 | 63.3% |
| Tri(p-tolyl)phosphine | EDG | 96.7 | 66.7% |
| Triphenyl Phosphine | Neutral | 97.5 | 93.3% |
| Tris(p-fluorophenyl)phosphine | EWG | 97.8 | 103.3% |
| Tris(o-methoxyphenyl)phosphine | EDG | 96.6 | 63.3% |
| Tri(o-tolyl)phosphine | EDG | 96.6 | 63.3% |

EXAMPLE 6

An aviation gasoline consisting of 80 volume percent alkylate, 15 volume percent toluene and 5 volume % isopentane was treated with 125 mg Mn/L, from MMT. The resulting aviation gasoline blend was treated with either 33 mg P/L of diethyl phosphoramidate, 89 mg P/L of Di-tert-butyl N,N-diisopropylphosphoramidite, or 89 mg P/L of diethyl phenylamidophosphate. Antiknock effectiveness of 13.8%, <0%, and 6.9% were observed respectively. This further reinforces the concept that incorporation of electron rich, nucleophilic alkoxy or amine groups are disfavored.

EXAMPLE 7

An aviation gasoline consisting of 80 volume percent alkylate, 15 volume percent toluene and 5 volume % isopentane was treated with 125 mg Mn/L, from MMT. To this base fuel a manganese scavenger, consisting of an organophosphorous compound shown in Table 5 was added. Tris (pentafluorophenyl)phosphine, containing the highly electron deficient pentafluorophenyl group, resulted in antiknock effectiveness comparable to triphenyl phosphine. This provides further evidence that electron poor substituents bonded to a phosphine are highly effective Mn scavengers due to their limited antagonism of MMT.

TABLE 5

| Blend | Treat Rate of Scavenger (mg P/L) | Motor Octane Number | % Antiknock Effectiveness |
|---|---|---|---|
| Base Fuel Control | 0 | 94.7 | 0.0% |
| No Scavenger Control | 0 | 98.3 | 100% |
| Triphenyl Phosphine | 16.5 | 97.4 | 75.% |
| Triphenyl Phosphine | 44 | 97.6 | 80.6% |
| Tris(pentafluorophenyl) Phosphine | 16.5 | 97.4 | 75.0% |
| Tris(pentafluorophenyl) Phosphine | 44 | 97.2 | 69.4% |

EXAMPLE 8

Phosphites are structurally similar to phosphines. To demonstrate the significant improvement in antiknock effectiveness by changing the P—OR groups to more electron deficient ones, the following aviation gasoline blends were prepared. An aviation gasoline consisting of 80 volume percent alkylate, 15 volume percent toluene and 5 volume % isopentane was treated with 125 mg Mn/L, from MMT. To this base fuel a manganese scavenger, consisting of a phosphite shown in Table 6 was added. It becomes readily apparent more electron withdrawing groups are favored. Replacement of a triethoxy group with a tris(2,2,2-trifluoro) ethoxy group improves the antiknock effectiveness of MMT. Fluorine atoms are known to those skilled in the art to have an inductive electron withdrawing effect, which in this case reduces the electron density and nucleophilicity of the corresponding alkoxide. Installing a more electron withdrawing group such as an aryl ring further improves antiknock effectiveness (triphenyl phosphate). Aryl rings can delocalize electrons via resonance effects and that resonance effects are stronger than inductive effects. This clearly demonstrates a correlation between electron withdrawing effects and antiknock effectiveness.

TABLE 6

| Blend | Treat Rate of Scavenger (mg P/L) | Motor Octane Number | % Antiknock Effectiveness |
|---|---|---|---|
| Base Fuel Control | 0 | 94.7 | 0.0% |
| No Scavenger Control | 0 | 98.2 | 100% |

TABLE 6-continued

| Blend | Treat Rate of Scavenger (mg P/L) | Motor Octane Number | % Antiknock Effectiveness |
|---|---|---|---|
| Triethyl Phosphite | 16.4 | 95.3 | 17.1% |
| Triethyl Phosphite | 33 | 95 | 8.6% |
| Triethyl Phosphite | 89 | 94.1 | <0.0% |
| Tris(2,2,2-fluoroethyl) Phosphite | 16.4 | 95.6 | 25.7% |
| Tris(2,2,2-fluoroethyl) Phosphite | 33 | 95.8 | 31.4% |
| Tris(2,2,2-fluoroethyl) Phosphite | 89 | 95.2 | 14.3% |
| Triphenyl Phosphite | 16.4 | 97.2 | 71.4% |
| Triphenyl Phosphite | 33 | 97.1 | 68.6% |
| Triphenyl Phosphite | 89 | 95.7 | 28.6% |

EXAMPLE 9

An aviation gasoline consisting of 80 volume percent alkylate, 15 volume percent toluene and 5 volume % isopentane was treated with 225 mg Mn/L, from MMT. To this base fuel a manganese scavenger, consisting of triphenyl phosphine at different treat rates, was added as shown in Table 7. Similar antiknock effectiveness was observed at higher treat rates compared to lower Mn treat rates.

TABLE 7

| Blend | Treat Rate of Scavenger (mg P/L) | Motor Octane Number | % Antiknock Effectiveness |
|---|---|---|---|
| Base Fuel Control | 0 | 94.7 | 0.0% |
| No Scavenger Control | 0 | 100.0 | 100% |
| Triphenyl Phosphine | 29.6 | 99.1 | 83.0% |
| Triphenyl Phosphine | 89.0 | 98.6 | 73.6% |
| Triphenyl Phosphine | 160.7 | 98.1 | 64.2% |

EXAMPLE 10

An aviation gasoline consisting of 80 volume percent alkylate, 15 volume percent toluene and 5 volume % isopentane was treated with 225 mg Mn/L, from MMT. To this base fuel, manganese scavengers consisting of different phosphines were added as shown in Table 8. The progressive removal of aryl groups and their replacement with cyclohexyl groups reduces the antiknock effectiveness. Replacement of either the aryl or cyclohexyl group with a linear alkyl group such as an n-octyl chain dramatically reduces antiknock effectiveness. It becomes readily apparent that in addition to electron effects, steric effects can play a role in MMT antagonism. Cyclohexyl rings adopt a chair conformation—this bulky conformation reduces their reactivity compared to linear alkyl groups.

TABLE 8

| Blend | Treat Rate of Scavenger (mg P/L) | Motor Octane Number | % Antiknock Effectiveness |
|---|---|---|---|
| Base Fuel Control | 0 | 94.7 | 0.0% |
| No Scavenger Control | 0 | 100.0 | 100% |
| Dicyclohexylphenyl Phosphine | 29.6 | 98.2 | 66.0% |
| Dicyclohexylphenyl Phosphine | 89.0 | 95.5 | 15.1% |
| Dicyclohexylphenyl Phosphine | 160.7 | 94.2 | <0.0% |
| Tricyclohexyl Phosphine | 29.6 | 97.0 | 43.4% |
| Tricyclohexyl Phosphine | 89.0 | 95.4 | 13.2% |

TABLE 8-continued

| Blend | Treat Rate of Scavenger (mg P/L) | Motor Octane Number | % Antiknock Effectiveness |
|---|---|---|---|
| Tricyclohexyl Phosphine | 160.7 | 95.0 | 5.7% |
| Tri-n-octyl Phosphine | 29.6 | 95.3 | 11.3% |
| Tri-n-octyl Phosphine | 89.0 | 95.0 | 5.7% |
| Tri-n-octyl Phosphine | 160.7 | 94.9 | 3.8% |

EXAMPLE 11

An aviation gasoline blend consisting of 95 volume % alkylate and 5 volume % isopentane was treated with 125 mg Mn to give a Motor Octane rating of 98.1. Addition of 16.5 mg P/L as triphenyl phosphine resulted in an aviation gasoline having a Motor Octane rating of 97.7.

EXAMPLE 12

An aviation gasoline blend consisting of 65 volume % alkylate, 30 vol % toluene and 5 volume % isopentane was treated with 125 mg Mn to give a Motor Octane rating of 97.2. Addition of 16.5 mg P/L as triphenyl phosphine resulted in an aviation gasoline having a Motor Octane rating of 97.1.

EXAMPLE 13

An aviation gasoline blend consisting of 80 volume % alkylate, 15 vol % toluene and 5 volume % isopentane was treated with 125 mg Mn to give a Motor Octane rating of 97.9. Addition of 16.5 mg P/L as triphenyl phosphine resulted in an aviation gasoline having a Motor Octane rating of 97.8.

EXAMPLE 14

An aviation gasoline blend consisting of 80 volume % alkylate, 15 vol % ethanol and 5 volume % isopentane was treated with 125 mg Mn to give a Motor Octane rating of 98.4. Addition of 16.5 mg P/L as triphenyl phosphine resulted in an aviation gasoline having a Motor Octane rating of 98.2.

EXAMPLE 15

An aviation gasoline blend consisting of 80 volume % alkylate, 15 vol % acetone and 5 volume % isopentane was treated with 125 mg Mn to give a Motor Octane rating of 99.4. Addition of 16.5 mg P/L as triphenyl phosphine resulted in an aviation gasoline having a Motor Octane rating of 99.2.

EXAMPLE 16

An aviation gasoline blend consisting of 24 volume/0 alkylate, 18 vol % toluene, 50 vol % isooctane and 8 volume % isopentane was treated with 125 mg Mn to give a Motor Octane rating of 100.3. Addition of 16.5 mg P/L as triphenyl phosphine resulted in an aviation gasoline having a Motor Octane rating of 100.4.

EXAMPLE 17

An aviation gasoline blend consisting of 22 volume % alkylate, 18 vol % toluene, 50 vol % isooctane and 10 volume % isopentane was treated with 125 mg Mn to give a Motor Octane rating of 100.4. Addition of 16.5 mg P/L as triphenyl phosphine resulted in an aviation gasoline having a Motor Octane rating of 100.2.

This invention is susceptible to considerable variation in its practice. Therefore, the foregoing description is not intended to limit, and should not be construed as limiting, the invention to the particular exemplifications presented herein. Rather, what is intended to be covered is as set forth in the following claims and the equivalents thereof as permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

That which is claimed is:

1. An aviation gasoline formulation comprising:

gasoline;

a manganese-containing anti-knock component; and a manganese scavenger component, wherein the manganese scavenger component comprises molecules made up of a central atom and entities attached to the central atom;

wherein the central atom is a Group 15 element selected from the group consisting of phosphorous, arsenic, antimony, and bismuth;

wherein the entities attached to the central atom are electron withdrawing entities selected from the group consisting of electron deficient atoms and electron deficient functional groups;

wherein the electron withdrawing entity includes a substituted aryl group that is directly attached to the central atom through a carbon bonded to the central atom; and wherein the substituent on the aryl group is selected from the group consisting of fluorine, chlorine, and bromine; wherein the aviation gasoline formulation is lead free.

2. An aviation gasoline formulation as described in claim 1, wherein the entities attached to the central atom do not contain electron donating substituents.

3. An aviation gasoline formulation as described in claim 1, wherein the manganese scavenger component comprises a trivalently bonded central atom.

4. An aviation gasoline formulation as described in claim 1, wherein the aryl group is selected from the group consisting of benzene, naphthalene, and other polyaromatic groups.

5. An aviation gasoline formulation as described in claim 1, wherein the manganese scavenger component is selected from the group consisting of substituted triphenyl phosphine, substituted triphenyl phosphine oxide and substituted triphenyl antimony.

6. An aviation gasoline formulation as described in claim 1, wherein the electron withdrawing entity has a Tolman electronic parameter ranging from 2085-2110 $^{\nu}CO(A_1)$ and Tolman cone angle ranging from 110-135 θ.

7. An aviation gasoline formulation as described in claim 1, wherein the electron withdrawing entity has a Tolman electronic parameter ranging from 2067-2080 $^{\nu}CO(A_1)$ and Tolman cone angle ranging from 140-160 θ.

8. An aviation gasoline formulation as described in claim 1, wherein the electron withdrawing entity has a Tolman electronic parameter ranging from 2080-2095 $^{\nu}CO(A_1)$ and Tolman cone angle ranging from 160-185 θ.

9. An aviation gasoline formulation as described in claim 1, wherein the electron withdrawing entity has a Tolman electronic parameter ranging from 2050-2060 $^{\nu}CO(A_1)$ and Tolman cone angle ranging from 165-175 θ.

10. A method of improving the performance of organomanganese aviation gasoline additive compounds during the combustion of that gasoline in an aviation internal combustion engine, the method comprising the steps of providing an gasoline that includes an organomanganese anti-knock compound;

mixing into the gasoline a manganese scavenging component comprising molecules made up of a central atom and entities attached to the central atom;

wherein the central atom is a Group 15 element selected from the group consisting of phosphorous, arsenic, antimony, and bismuth;

wherein the entities attached to the central atom are electron withdrawing entities selected from the group consisting of electron deficient atoms and electron deficient functional groups;

wherein the electron withdrawing entity includes a substituted aryl group that is directly attached to the central atom through a carbon bonded to the central atom; and wherein the substituent on the aryl group is selected from the group consisting of fluorine, chlorine, and bromine; wherein the aviation gasoline formulation is lead free.

11. An aviation gasoline formulation as described in claim 1, wherein the substituent is fluorine.

12. A method of improving the performance of organomanganese aviation gasoline additive compounds during the combustion of that gasoline in an aviation internal combustion engine as described in claim 10 wherein the substituent is fluorine.

* * * * *